US009926930B2

(12) United States Patent
Haugaard

(10) Patent No.: US 9,926,930 B2
(45) Date of Patent: Mar. 27, 2018

(54) VANE PUMP

(71) Applicant: Danfoss A/S, Nordborg (DK)

(72) Inventor: Erik Haugaard, Grasten (DK)

(73) Assignee: Danfoss A/S, Nordborg (DK)

( * ) Notice: Subject to any disclaimer, the term of this patent is extended or adjusted under 35 U.S.C. 154(b) by 195 days.

(21) Appl. No.: 15/017,759

(22) Filed: Feb. 8, 2016

(65) Prior Publication Data

US 2016/0230758 A1 Aug. 11, 2016

(30) Foreign Application Priority Data

Feb. 11, 2015 (EP) ..... 15154614

(51) Int. Cl.
*F04C 15/06* (2006.01)
*F04C 2/34* (2006.01)
*F04C 2/344* (2006.01)

(52) U.S. Cl.
CPC ..... *F04C 15/06* (2013.01); *F04C 2/3441* (2013.01); *F04C 2/3448* (2013.01); *F04C 2250/101* (2013.01); *F04C 2250/102* (2013.01)

(58) Field of Classification Search
CPC ..... F04C 15/06; F04C 2/3441; F04C 2/3448; F04C 2550/101; F04C 2550/102
USPC ..... 418/229
See application file for complete search history.

(56) References Cited

U.S. PATENT DOCUMENTS 4,561,834 A * 12/1985 Poss ..... F01C 21/0809 418/150
4,898,526 A * 2/1990 Sakamaki ..... F01C 21/0836 418/257
5,102,314 A 4/1992 Staudenrausch
5,421,706 A * 6/1995 Martin, Sr. ..... F04C 2/3441 417/371
7,048,526 B2 * 5/2006 Patterson ..... F01C 21/0845 418/146
8,257,071 B2 * 9/2012 Matsuki ..... F04C 2/3442 418/145

FOREIGN PATENT DOCUMENTS

| | | | |
|---|---|---|---|
| CN | 101080573 | A | 11/2007 |
| CN | 203584904 | U | 5/2014 |
| CN | 104220753 | A | 12/2014 |
| CN | 104279158 | A | 1/2015 |
| EP | 0 134 636 | A1 | 3/1985 |
| GB | 2 383 611 | A | 7/2003 |
| JP | 2010265852 | A | 11/2010 |

* cited by examiner

*Primary Examiner* — Patrick Maines
*Assistant Examiner* — Dapinder Singh
(74) *Attorney, Agent, or Firm* — McCormick, Paulding & Huber LLP

(57) ABSTRACT

A vane pump (1) is disclosed comprising a housing (2) having a stator bore, a rotor (4) being rotatably mounted within said stator bore, and having a number of vanes (5) slidably mounted in said rotor (4) in radial direction of said rotor (4), an inlet (11) and an outlet (12). Such a vane pump should have a good efficiency. To this end said inlet (11) opens in an axial end wall of said stator bore (3) and said outlet (12) is connected to an outflow area formed in a circumferential wall (3) of said stator bore.

18 Claims, 1 Drawing Sheet

VANE PUMP

CROSS REFERENCE TO RELATED APPLICATION

Applicant hereby claims foreign priority benefits under U.S.C. § 119 from European Patent Application No. EP15154614.0 filed on Feb. 11, 2015, the content of which is incorporated by reference herein.

TECHNICAL FIELD

The present invention relates to a vane pump comprising a housing having a stator bore, a rotor being rotatably mounted within said stator bore and having a number of vanes slidably mounted in said rotor in radial direction of said rotor, an inlet and an outlet.

BACKGROUND

Such a vane pump can be used, for example, as booster pump in connection with a pressure exchanger wherein the combination of pressure exchanger and booster pump is used in connection with a reverse osmosis system. When the rotor rotates, pump chambers formed by the housing, the rotor and the vanes decrease and increase their volumes. During the increase phase of the volume of the chambers liquid is sucked into the chambers. During the decreasing phase of the volume of the chambers liquid is pumped out of the chambers.

SUMMARY

The object underlying the invention is to have a vane pump with a good efficiency.

This object is solved with a vane pump as described at the outset in that said inlet opens in an axial end wall of said stator bore and said outlet is connected to an outflow area formed in a circumferential wall of said stator bore.

In such a vane pump liquid is supplied into the pump chambers formed by the housing, the rotor and the vanes with a velocity component in axial direction so that the incoming liquid can use its own inertia to fill quickly the pressure chamber. Pressure losses can be kept small. During the rotation of the rotor the liquid in the pressure chambers experiences a centrifugal force. This centrifugal force can be additionally used to push the liquid out of the pump chambers saving again energy.

Preferably said outflow area is formed as an outlet recess in said circumferential wall. The outflow of the liquid can start as soon as a pump chamber comes into an overlapping relation with said outlet recess and the flow resistance for the liquid decreases with a further rotation of the rotor thereby keeping losses small.

In a preferred embodiment said inlet is connected to a kidney-shaped inlet recess in an axial end wall of said stator bore, said inlet recess having a width in radial direction, said width increasing in a direction of rotation of said rotor. The incoming liquid not only has a directional component in axial direction with respect to the rotational axis of the rotor. The incoming liquid flows in tangential or circumferential direction of the rotor as well. Since the width increases in the direction of rotation of the rotor the flow resistance for the liquid decreases. The flow channel that supplies liquid to the pump chambers is twisted along the rotor axis so that the fluid gets a velocity component in the direction of the rotation of the pump chambers.

Preferably said rotor is positioned eccentrically within said stator bore, wherein a radially inner border of said inlet recess runs parallel to a circle line around a rotational axis of said rotor and a radially outer border of said inlet recess runs parallel to said circumferential wall of said stator bore. The increasing width of the inlet recess is formed using the eccentricity of the location of the rotor within the stator bore. This makes the construction simple.

In a preferred embodiment said rotor has a core, wherein said radially inner border of said inlet recess is on a same radius as a radially outer face of said core. The core is basically a cylinder from which stabilization means guiding the vanes protrude outwardly in radial direction. In this way it is possible to make the area in which the liquid can flow out of the inlet recess into the pump chambers as large as possible.

Preferably said inlet recess comprises a trailing border running parallel to a radial direction of said rotor. In most cases the vanes are oriented in a radial direction. When the trailing edge of the inlet recess is arranged parallel to the vane in the moment when the vane passes this trailing edge further movement of the rotor in rotational direction can be used to pressurize the liquid within a pressure chamber without giving the liquid the possibility to escape out of the pressure chamber.

Preferably a slit-like opening is located in a bottom of said inlet recess connecting said inlet recess to said input. The slit-like opening allows the incoming liquid to be distributed along the length of the recess in circumferential direction with small losses.

Preferably said outlet recess has a depth in radial direction, said depth increasing in direction of rotation of the rotor. This means that the flow resistance for the outputted liquid decreases when the rotor together with the pump chambers is moved in rotational direction towards the outlet thereby minimizing losses. Preferably the depth of the outlet recess is designed to keep the velocity of the fluid nearly constant.

Preferably said outlet recess is shorter in axial direction than said vanes. The remaining part of the circumferential wall of the stator bore can be used to guide the vanes.

Preferably said outlet is inclined with respect to a radial direction of the stator bore by an angle in a range from 30° to 60°. The outputted liquid not only is subject to a centrifugal force but has also a component of movement in tangential direction. Inclination of the output uses in an advantageous form both the centrifugal force as well as the tangential component of the movement of the outputted liquid which is a further measure to have a good efficiency.

In a preferred embodiment said inlet is structured and arranged to be directly connected to another hydraulic machine. In this case it is possibly to form the connection between the vane pump and the hydraulic machine without any tubing or other external piping. Such a unit of vane pump and hydraulic machine can form, for example, a hydraulic arrangement used for recovering pressure in a reverse osmosis system.

BRIEF DESCRIPTION OF THE DRAWINGS

A preferred embodiment of the invention is now described in more detail with reference to the drawing, wherein.

DETAILED DESCRIPTION

Figure 1:
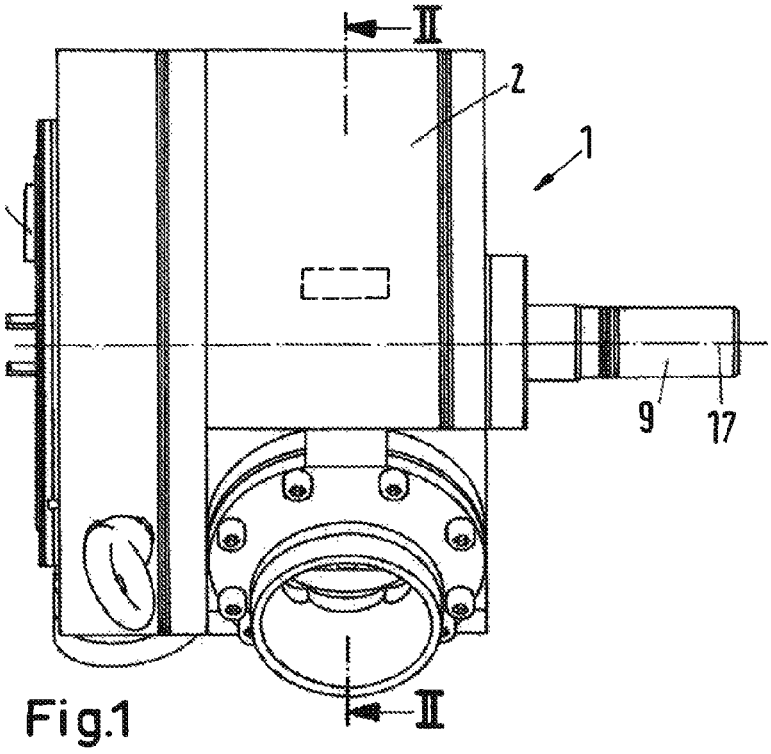
FIG. 1 is a front view of a vane pump.

A vane pump 1 comprises a housing 2 having a stator bore 3 of, for example, cylinder form. The stator bore has a circumferential wall 3.

A rotor 4 is located within said stator bore. The rotor 4 carries a number of vanes 5. Each vane is moveable in radial direction with respect to the rotor 4. To this end the rotor 4 comprises a core 6 and, for each vane 5, a protrusion 7 in which a slit 8 is formed. The vane 5 is slidably positioned within said slit 8.

The rotor 4 is fixed to a shaft 9 in rotational direction. When the shaft 9 is rotated the rotor 4 is driven. The direction of rotation is indicated with an arrow 10.

An inlet 11 is provided at an axial end of the housing 2. Furthermore, an outlet 12 having an outlet axis 13 is provided at a circumferential outside of the housing 2.

The inlet 11 can be structured and arranged to be directly connected to another hydraulic machine, for example, to a pressure exchanger. In this case it is possible to form the connection between the hydraulic machine and the vane pump without any tubing or other external piping. In such case it would be preferable to make the inlet 11 flush with the side of the housing 2 in which it is arranged.

Figure 2:
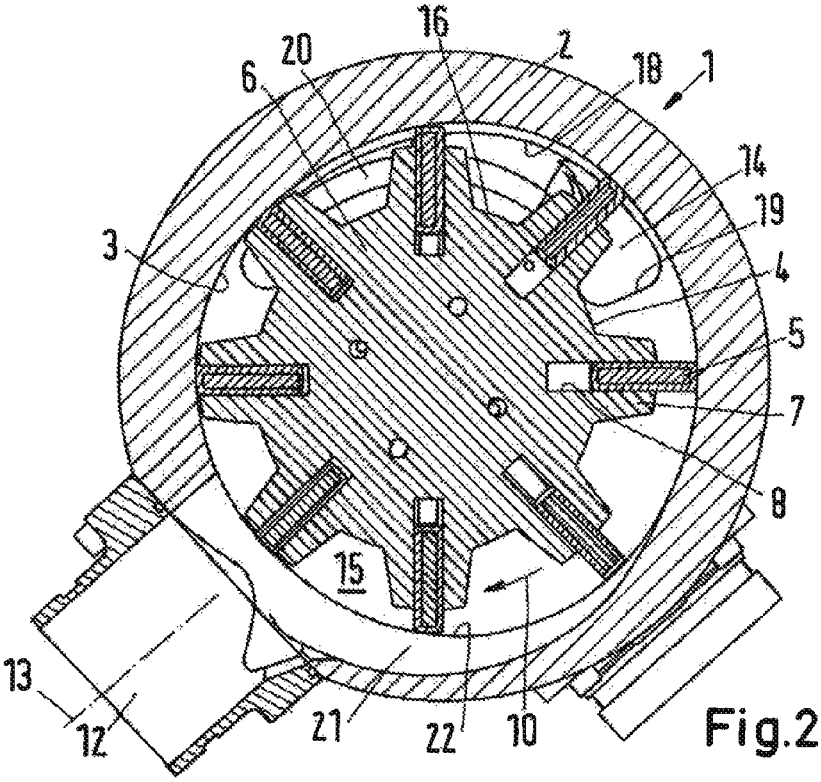
FIG. 2 is a section II-II of FIG. 1.

The inlet 11 is connected to a kidney-shaped inlet recess 14 in an axial end wall of the stator bore 3 on the side of the housing 2 near the inlet 11. The inlet recess 14 has a width in radial direction. As can be seen in FIG. 2 this width increases in the direction 10, i.e. in the direction of rotation of the rotor 4.

As can be seen in FIG. 2, the rotor 4 is positioned eccentrically within the stator bore. When the rotor 4 is rotated in direction 10, each pumping chamber 15 which is formed by the core 6, the protrusions 7, two vanes 5, the housing 2 and two axial end walls of the housing (not shown) increase and decrease its volume. In a region in which the inlet recess 14 is formed the pumping chambers 15 increase the volume and in a region between the inlet recess 14 and the outlet 12 the pumping chambers 15 decrease their volume.

The inlet recess 14 has a radially inner border 16 which runs parallel to a circle line around a rotational axis 17 of the rotor 4, more precisely the radially inner border 16 coincides with the radially outer face of the core 6 of the rotor.

The inlet recess furthermore has a radially outer border 18 running parallel to a circumferential wall of said stator bore 3. The radially outer border 18 can have, as shown, a small distance to the circumferential wall 3 of the stator bore. However, it is possible as well that the radially outer border 18 has the same radius as the stator bore.

The inlet recess has a trailing edge 19 (or trailing border) which runs parallel to a radial direction of the rotor 4. Since the vanes 5 are arranged radially within the rotor 4, each vane 5 is parallel to the trailing edge 19 in the moment the vane 5 passes the trailing edge 19. In other words, the pumping chamber 15 is closed immediately once the vane 5 passes the trailing edge 19.

A slit-like opening 20 is provided in a bottom of the inlet recess 14. The slit-like opening 20 connects inlet 11 and inlet recess 14 and allows for a smooth distribution of incoming liquid in circumferential direction of the inlet recess 14.

The stator bore has an outflow area formed as an outlet recess 21 in the circumferential wall 3 of the stator bore. This outlet recess 21 has an axial length which is a bit shorter than the axial length of the vanes 5 so that a guiding face 22 remains within stator bore controlling the movement of the vanes 5.

As can be seen in FIG. 2, the outlet recess has a depth in radial direction, said depth increasing in direction 10 of rotation of the rotor 4.

During rotation of the rotor 5 liquid trapped in a pumping chamber 15 experiences a centrifugal force, i.e. a force acting on the liquid radially to the outside of the rotor 4. At the same time the liquid trapped in the pumping chamber 15 has a rotational velocity corresponding to the rotational speed of the rotor 4. The axis 13 of the outlet 12 can be inclined with respect to a radial direction of the rotor 4 (not shown) so that the advantageous effect of the centrifugal force moving the liquid in radial direction once the pumping chamber 15 has come in overlapping relation with the outlet recess 21 and furthermore the tangential velocity of the trapped fluid 15 can be used to move the liquid with low losses out of the pumping chambers 15 and into the outlet 12.

Therefore, the vane pump 1 can be used with low losses and a good efficiency.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A vane pump comprising:

a housing having a stator bore;

a rotor rotatably mounted within said stator bore;

a number of vanes slidably mounted in said rotor in radial direction of said rotor;

an inlet; and an outlet;

wherein said inlet opens into an inlet recess in an axial end wall of said stator bore and said outlet is connected to an outflow area formed in a circumferential wall of said stator bore; and wherein a radially inner border of said inlet recess runs parallel to a circle line around a rotational axis of said rotor and a radially outer border of said inlet recess runs parallel to said circumferential wall of said stator bore.

2. The vane pump according to claim 1, wherein said outflow area is formed as an outlet recess in said circumferential wall.

3. The vane pump according to claim 1, wherein said inlet recess is kidney-shaped, said inlet recess having a width in radial direction, said width increasing in a direction of rotation of said rotor.

4. The vane pump according to claim 1, wherein said rotor has a core, wherein said radially inner border of said inlet recess is on a same radius as an radially outer face of said core.

5. The vane pump according to claim 1, wherein said inlet recess comprises a trailing border running parallel to a radial direction of said rotor.

6. The vane pump according to claim 3, wherein a slit-like opening is located in a bottom of said inlet recess connecting said inlet recess to said input.

7. The vane pump according to claim 1, wherein said outlet recess has a depth in radial direction, said depth increasing in direction of rotation of said rotor.

8. The vane pump according to claim 1, wherein outlet recess is shorter in axial direction than said vanes.

9. The vane pump according to claim 1, wherein said outlet is inclined with respect to a radial direction of said stator bore by an angle in a range from 30° to 60°.

10. The vane pump according to claim 1, wherein said inlet is structured and arranged to be directly connected to another hydraulic machine.

11. The vane pump according to claim 2, wherein said inlet recess is kidney-shaped, said inlet recess having a width in radial direction, said width increasing in a direction of rotation of said rotor.

12. The vane pump according to claim 4, wherein said inlet recess comprises a trailing border running parallel to a radial direction of said rotor.

13. The vane pump according to claim 1, wherein a slit-like opening is located in a bottom of said inlet recess connecting said inlet recess to said input.

14. The vane pump according to claim 4, wherein a slit-like opening is located in a bottom of said inlet recess connecting said inlet recess to said input.

15. The vane pump according to claim 5, wherein a slit-like opening is located in a bottom of said inlet recess connecting said inlet recess to said input.

16. The vane pump according to claim 2, wherein said outlet recess has a depth in radial direction, said depth increasing in direction of rotation of said rotor.

17. The vane pump according to claim 3, wherein said outlet recess has a depth in radial direction, said depth increasing in direction of rotation of said rotor.

18. The vane pump according to claim 4, wherein said outlet recess has a depth in radial direction, said depth increasing in direction of rotation of said rotor.

* * * * *